United States Patent [19]

Appelbaum

[11] Patent Number: 5,063,766

[45] Date of Patent: Nov. 12, 1991

[54] LOCKABLE KEYWAY COVER

[76] Inventor: Paul Appelbaum, Box 27006, Denver, Colo. 80227

[21] Appl. No.: 570,012

[22] Filed: Aug. 20, 1990

[51] Int. Cl.[5] ..... E05B 17/14

[52] U.S. Cl. ..... 70/428; 70/455

[58] Field of Search ..... 70/455, 423–428

[56] References Cited

U.S. PATENT DOCUMENTS

| | | | |
|---|---|---|---|
| 3,167,945 | 2/1965 | Goodman | 70/455 |
| 3,635,057 | 1/1972 | Foote et al. | 70/212 X |
| 3,739,608 | 6/1973 | Young | 70/428 X |
| 3,866,445 | 2/1975 | Erwin | 70/455 X |
| 4,073,165 | 2/1978 | Grundstrom et al. | 70/455 X |
| 4,107,967 | 8/1978 | Grabb | 70/427 |
| 4,123,924 | 11/1978 | Dworkis | 70/428 X |
| 4,227,388 | 10/1980 | Nigrelli et al. | 70/427 |
| 4,301,669 | 11/1981 | Floyd | 70/428 |
| 4,953,371 | 9/1990 | Appelbaum | 70/32 |

FOREIGN PATENT DOCUMENTS

| | | | |
|---|---|---|---|
| 1209755 | 9/1959 | France | 70/455 |

*Primary Examiner*—Lloyd A. Gall

*Attorney, Agent, or Firm*—Charles C. Corbin

[57] ABSTRACT

A lockable cover for the keyway of a cam-type lock, including an annular skirt attached to the body of the cam lock adjacent the inward end of the front-key way end of the lock. There is locking means for engaging the annular skirt, which locking means is generally rectangular and has a front wall with an aperture therein sufficient to accommodate the annular skirt adjacent which aperture there are latching heads of the lock which have an open configuration in which they are spaced apart sufficiently to receive the periphery of the annular skirt and a locked configuration in which the shaped latching heads are brought together to lockably embrace the annular skirt thereby covering the keyway portion of the lock.

2 Claims, 2 Drawing Sheets

LOCKABLE KEYWAY COVER

BACKGROUND

1. Field of the Invention

The present invention relates to devices for covering the keyways of locks, and more particularly the present invention relates to devices which lockably cover the keyways of cam-type locks.

2. Description of the Prior Art

Cam-type locks are quite popular and used extensively in a variety of applications such as the securing of cabinets and vending machines. While such locks have been advantageously employed for some time they remain with the drawback of being subject to tampering. This can be in the form of cylinder picking and forceful prying by way of the keyway. These locks are also vulnerable to being intentionally disabled by the injection of foreign disabling substances, such as glue, within the keyway so as to foul the locking mechanism. It is noted that the prior art is replete with examples and disclosures of keyway covers, such as that shown in U.S. Pat. No. 4,023,388 and 3,740,981. These disclosures are for covers which protectively shield the keyway from dust, moisture, and other airborne contaminants, however they do not secure, or present a barrier to access to, the keyway. Such prior art disclosures also fail to disclose apparatus for increasing the security provided by a cam lock.

SUMMARY OF THE INVENTION

In view of the aforestated drawbacks of prior cam lock apparatus, it is a general object of the invention to provide means for lockably covering the keyway of a cam-type lock.

Another object of the present invention is to provide a keyway cover that shields the keyway from dust, moisture and other environmental contaminants, as well as providing a barrier preventing ingress of environmental contaminants.

Yet another object is to provide a means for securing a cam lock that provides the use of two keys instead of one.

These and other objects and advantages will be provided by the present invention which comprises apparatus for lockably securing the keyway cover of a cam lock, the apparatus including an annular skirt mountable over the barrel of the cam lock adjacent the rear of the front, keyway-containing end of the cam lock. The invention also features a lock for releasably engaging the skirt of the cam lock, the lock including a generally rectangular case, having a central opening in its front wall, and the lock having a first, shaped latching head and a second, opposed shaped latching head, mounted within the lock case adjacent the opening in the front wall, the lock having an open position in which the shaped latching heads are spaced apart sufficiently to admit the annular skirt and having a closed, locked configuration in which the working heads are brought together so as to embrace the periphery of the skirt member.

In a preferred configuration the shaped working heads are adapted to slidably engage the periphery of the circumferential flange in a manner permitting rotation of a lock about the axis of the flange yet which holds against relative outward movement of the lock.

The accompanying drawings which form a part of the specifications illustrate a preferred embodiment of the apparatus of the present invention and together with the description serve to explain the principles of the invention.

DETAILED DESCRIPTION

Figure 2:
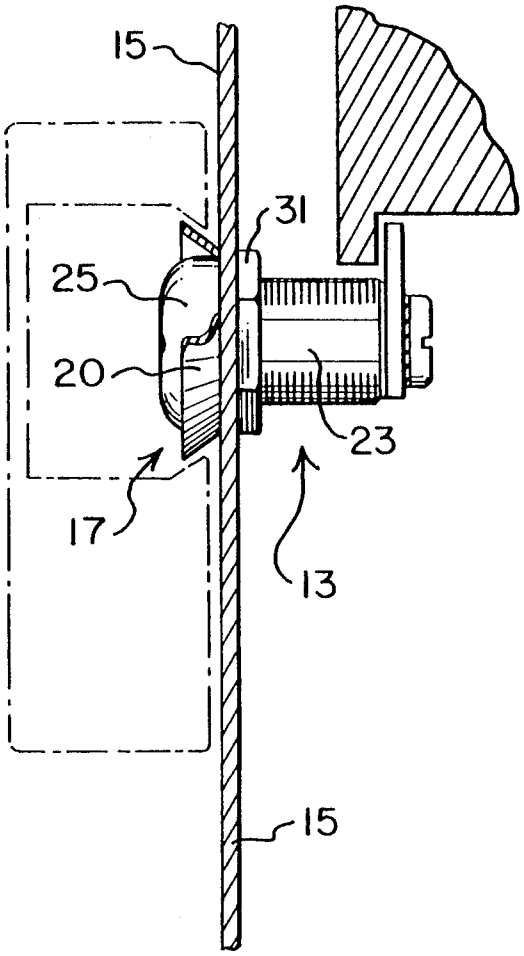
FIG. 2 is a partial sectional, elevational view with parts broken away for clarity, illustrating the application of a preferred embodiment of the invention.
Figure 1:
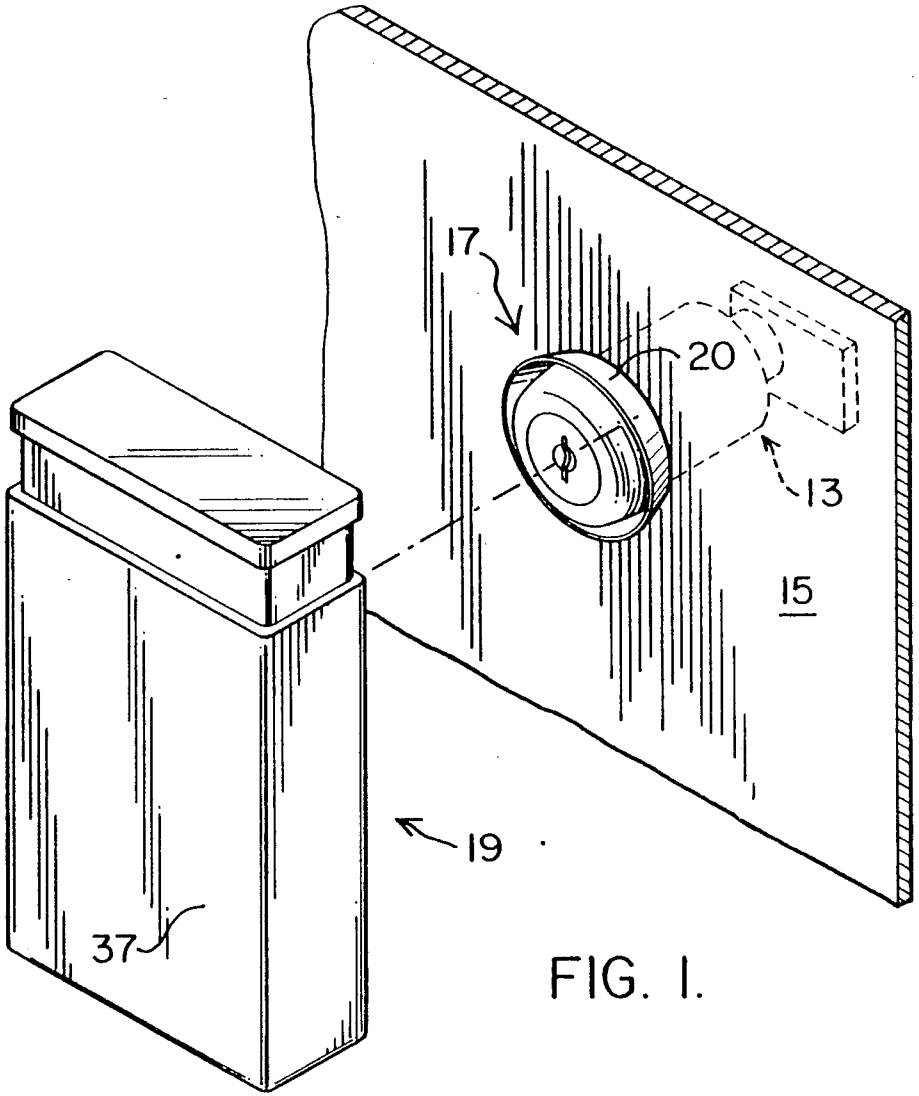
FIG. 1 is a view in perspective illustrating the components of a preferred embodiment of the present invention.
Figure 5:
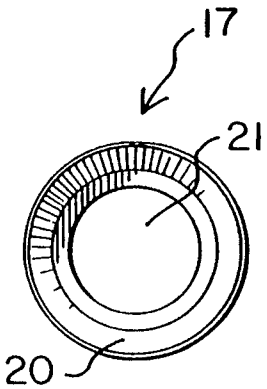
FIG. 5 is a top plan view of an annular skirt according to the present invention.

Referring now to the drawings, FIG. 1 illustrates the use of a preferred embodiment of the invention in conjunction with a cam lock 13 which is shown mounted to a cabinet wall 15. The main components of the present invention are herein shown to comprise an annular steel skirt 17 which is mounted to the front end of cam lock 13 in a manner to be described hereinafter, and a shackleless lock 19 which will also be described hereinafter. FIG. 2 illustrates that the annular skirt 17 has a circumferentially extending flange portion 20. FIG. 5 further shows that the annular skirt 17 has a central opening 21 which is designed to receive the cam lock cylinder 23 and to abut the inner shoulder of the keyway head 25 of lock 13 so as to hold the skirt against outer movement. From FIG. 2 it is appreciated that when the lock 13 is mounted to a cabinet wall 15, the cam lock cylinder 23 extends through a hole in the wall 15 and is held in place when the hex nut 31 is tightened about the cylinder 13 so as to compress and hold the skirt 17 between the wall 15 and the keyway head 25. Note that the peripheral skirt portion 20 extends at a forward inclination, however under the scope of this configuration various configurations and inclinations of the peripheral flange portion can take place.

The other component of the invention, the shackleless lock 19, is characterized by an outer protective metal case, including a front wall 33 that is equipped with a central opening 35. FIG. 1 shows that lock 19 has a solid rear wall 37. This shackleless lock 19 is fabricated and constructed quite similarly to the shackleless lock disclosed in the inventor's earlier U.S. Pat. No. 4,953,371, which patent is incorporated herein by reference.

The construction of lock 19, as the preferred embodiment of this component of the invention, differs from that shown in the above-referenced patent by having a larger central opening and by the differing shape given to the shaped ends of the vertically opposed shaped latching heads 41 and 43. There is a bottom wall, not shown, that contains a keyway to a conventional lock mechanism.

Figure 4:
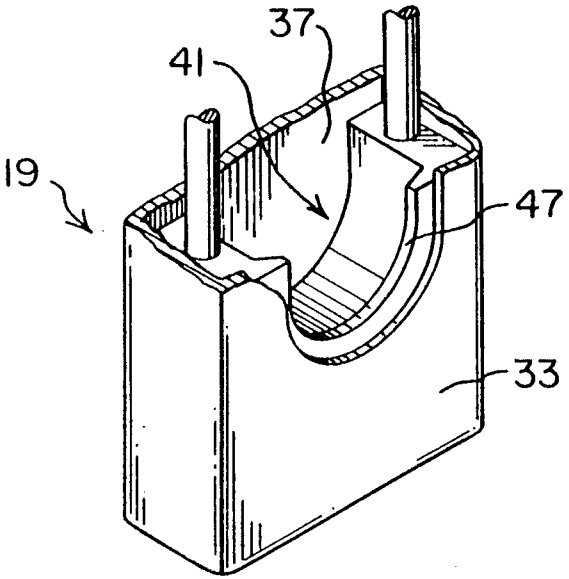
FIG. 4 is a perspective view with parts broken away of the locking component of FIG. 3.
Figure 3:
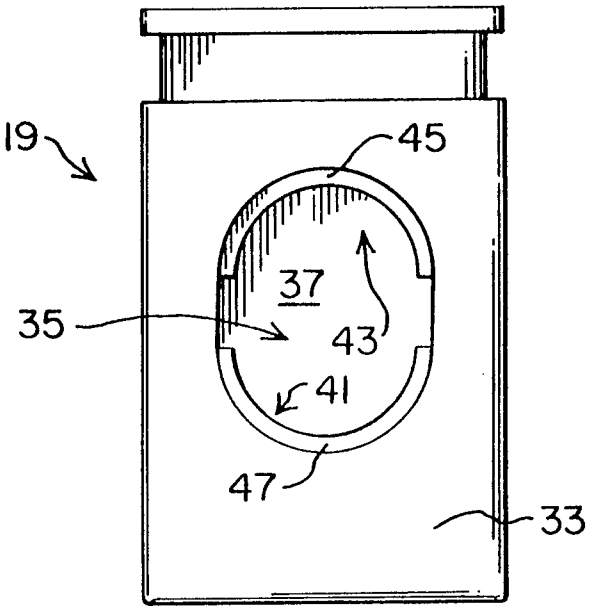
FIG. 3 is a front elevational view of the locking component of the present invention.

FIG. 3 shows that lock 19 can have an open configuration in which the upper latching head 43 is initially spaced apart from the lower latching head 41, there being provided a space between these latching heads sufficiently larger than the diameter of the annular skirt so as to accommodate it. The upper latching head 43 features a semi-circular retaining edge 45 and the bottom latching head 41 features a semi-circular retaining edge 47 of complementary curvature. FIG. 4 best shows the retaining edge 47 of the bottom latching head.

Lock 19 has a closed and locked configuration in which the opposing latching elements 43 and 41 are brought together in a position where lower retaining edge 47 and the upper edge 45 come together to form a generally overall circular edge which has a diameter that is smaller than the diameter of the peripheral portion 20. Thus, when lock 19 is brought to its locked configuration about the annular skirt 17 the edges 45 and 47 of the latching heads will lie behind the peripheral portion 20 of skirt 17. In the preferred embodiment, the latching heads of lock 19 do not firmly grasp the annular skirt 17 when in the position illustrated in FIG. 2. Rather, this is a loose fit allowing the lock 19 to rotate about the axis of the cam lock 13, while preventing outward removal of lock 19 with respect to the cam lock. By virtue of the barrier provided by the positioning of the entire case of lock 19, access to the keyway of the lock is prevented and additionally the keyway is shielded from contaminants.

A preferred embodiment has been described and it shall be appreciated with those in ordinary skill in the art, that within the scope of the invention, various changes may be made. Thus it is aimed to cover all the changes and modifications that fall within the true spirit and scope of the invention.

What is claimed is:

1. Lockable keyway cover apparatus for a cam lock having a generally cylindrical body with an outer end portion containing a keyway, said cover apparatus comprising:

a) annular skirt, co-axial with said cylindrical body and mounted to said cylindrical body adjacent said outer end portion, said skirt having a circumferentially extending flange portion;

b) generally rectangular lock means having walls enclosing locking mechanism and having a front wall with an opening adapted to receive said flange portion, and said lock means having within said opening a first shaped latching head spaced apart from a second shaped latching head, said lock means having an open configuration in which said latching heads are spaced apart sufficiently to accommodate said flange portion and said lock means having a locked configuration in which said first and second shaped latching heads are brought together to embrace said flange portion to hold said lock against outward movement relative to said cam lock; and c) wherein said shaped latching heads in locked configuration are adapted to slidably embrace said circumferential flange portion to permit complete rotation of said lock means about the axis of said cam lock cylindrical body and hold against outward movement of said lock means.

2. Apparatus as defined in claim 1 wherein said flange is inclined forwardly.

* * * * *